US008985031B2

(12) United States Patent
Gillotti

(10) Patent No.: US 8,985,031 B2
(45) Date of Patent: Mar. 24, 2015

(54) DESK TOP ELEVATOR

(71) Applicant: Michael Gillotti, Sebastopol, CA (US)

(72) Inventor: Michael Gillotti, Sebastopol, CA (US)

( * ) Notice: Subject to any disclaimer, the term of this patent is extended or adjusted under 35 U.S.C. 154(b) by 54 days.

(21) Appl. No.: 13/914,488

(22) Filed: Jun. 10, 2013

(65) Prior Publication Data

US 2014/0360414 A1 Dec. 11, 2014

Related U.S. Application Data

(60) Provisional application No. 61/661,585, filed on Jun. 19, 2012.

(51) Int. Cl.
*A47F 5/12* (2006.01)
*A47B 9/18* (2006.01)

(52) U.S. Cl.
CPC ..... *A47B 9/18* (2013.01)
USPC ..... 108/10

(58) Field of Classification Search
CPC ..... A47B 9/00; A47B 21/0314
USPC ..... 108/9, 10, 138, 144.11, 145, 146
See application file for complete search history.

(56) References Cited

U.S. PATENT DOCUMENTS 138,537 A * 5/1873 Sheaffer ..... 108/138
2,440,990 A * 5/1948 Van Dusen ..... 108/63
2,630,359 A * 3/1953 Schade ..... 108/136
3,257,975 A * 6/1966 Wiseman ..... 108/145
4,196,674 A * 4/1980 Van Laarhoven ..... 108/4
4,249,749 A * 2/1981 Collier ..... 280/35
4,682,750 A * 7/1987 Rudolph et al. ..... 108/145
4,926,760 A * 5/1990 Sack ..... 108/145
5,039,054 A * 8/1991 Pai ..... 248/423
7,024,710 B2 * 4/2006 Izuhara ..... 5/601
7,383,786 B2 * 6/2008 Giannasca ..... 114/343
7,637,468 B2 * 12/2009 Huang ..... 248/421
7,677,518 B2 * 3/2010 Chouinard et al. ..... 248/370
8,544,391 B2 * 10/2013 Knox et al. ..... 108/145
2002/0078866 A1 * 6/2002 Palmer ..... 108/145
2004/0040480 A1 * 3/2004 Hwang ..... 108/145
2006/0191449 A1 * 8/2006 Patten ..... 108/138
2007/0266912 A1 * 11/2007 Swain ..... 108/145

FOREIGN PATENT DOCUMENTS

FR 2571234 A1 * 4/1986 ..... A47B 9/18

* cited by examiner

*Primary Examiner* — Hanh V Tran
(74) *Attorney, Agent, or Firm* — Bay Area Technology Law Group PC

(57) ABSTRACT

A desktop elevator for providing a platform at an elevation adjustable by a user. The desktop elevator is positioned on a support surface and is provided with left, right, front and back frame members orthogonally attached to one another end to end. A platform is vertically adjustable to and from the support employing front and back rotatable brace members positioned on opposing frame members. The brace members together with channels, cutouts, locking pins and locking arms, enable the platform to be selectively distanced from the support upon moving the platform to and from it when locking latches are disengaged from the locking pins, the platform being drawn to and remaining adjacent to the support when pressure is supplied to the platform toward said support.

6 Claims, 5 Drawing Sheets

DESK TOP ELEVATOR

TECHNICAL FIELD

The present invention involves a desktop elevator for providing a platform with an elevation adjustable by a user. Such a device improves productivity and reduces strain associated with prolonged sitting. This invention can be applied to preexisting surfaces to convert them to the present desktop elevator and its corresponding adjustable platform.

BACKGROUND OF THE INVENTION

In our current computer oriented society, large numbers of people find themselves sitting at a desk or workstation for extended periods of time. This has resulted in a variety of work related injuries and loss of productivity. There have also been numerous studies conducted over the past several years that have identified serious health risks associated with prolonged sitting. These include the risks of high blood pressure, cardiovascular disease, diabetes and obesity as well as back pain and strain.

Studies have also shown that alternating between sitting and standing throughout the day helps to reduce these risks, reduces general fatigue and increases productivity.

It is thus an object of the present invention to provide a desktop elevator which, in large part, remedies the above-described health risks and does so without requiring that an entire desk or workstation be replaced or retrofitted with an elevating device.

It is yet a further object of the present invention to provide a desktop elevator which is capable of simple attachment to the top of an existing desk or work station and which can provide a platform that can be quickly and easily be elevated to enable a user to assume a standing position or lowered to assume a sitting position.

These and further objects of the present invention will be readily appreciated when considering the following disclosure and appended claims.

SUMMARY OF THE INVENTION

The present invention is directed to a desktop elevator for providing a platform at an elevation adjustable by a user, said desktop elevator comprising a support surface sized to receive the desktop elevator, left, right, front and back frame members, the frame members being orthogonally attached end to end to one another, a platform vertically adjustable to and from said support, front and back rotatable brace members each positioned on two opposing frame members, each having a first end rotatable to the platform and a second end rotatable to a frame member, springs each rotatably bridging said opposing frame member to a back rotatable brace member along its length and locking arms bridging an opposing frame member to a front rotatable brace member, locking pins positioned proximate on end of each of said locking arms proximate each of said opposing frame members and locking latches releasably engageable to said locking pins, said platform being distanced from said support upon lifting said platform therefrom when said locking latches are disengaged from said locking pins, said platform being drawn to and remaining adjacent to said support when pressure is applied to said platform toward said support.

DETAILED DESCRIPTION OF THE INVENTION

Figure 1:
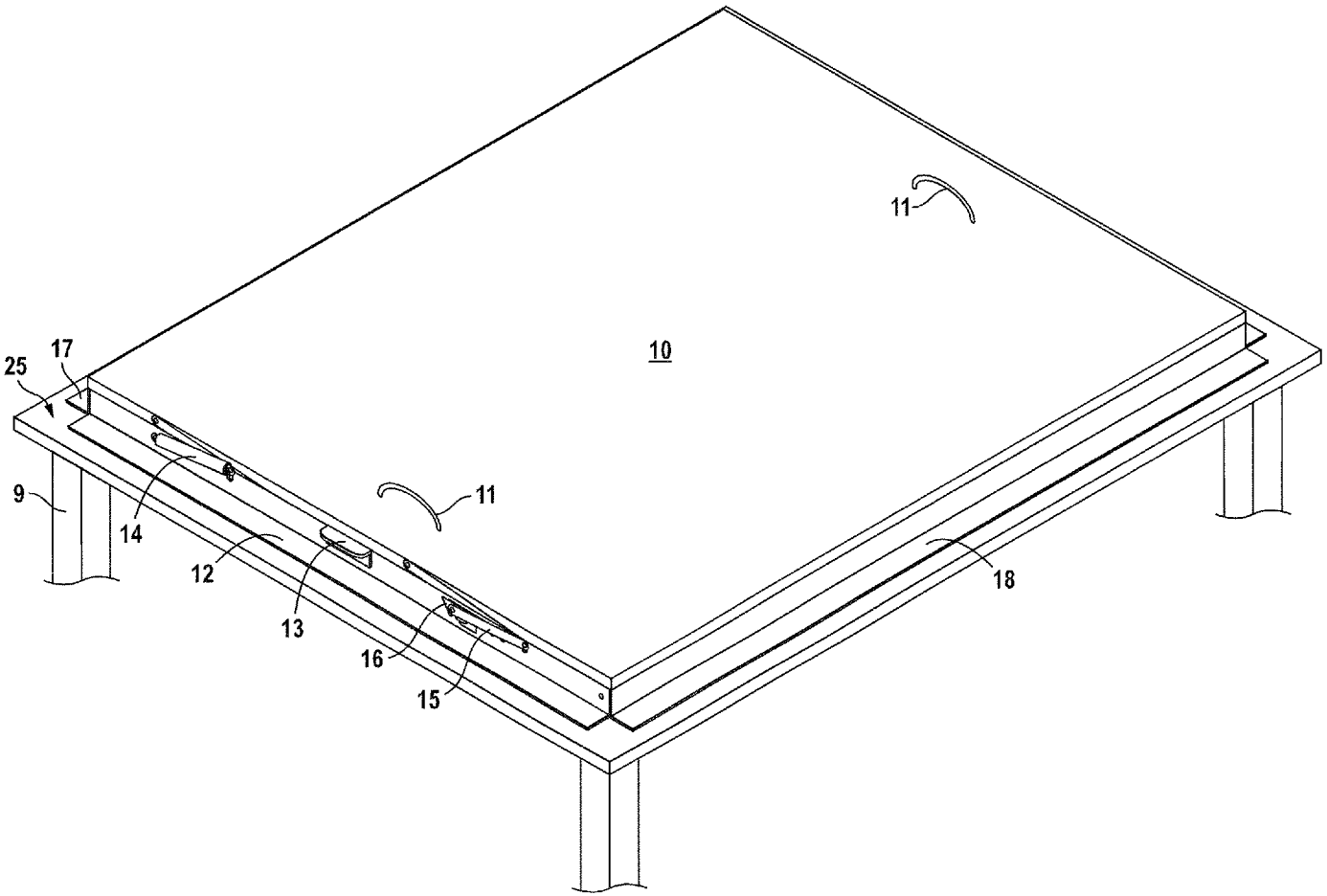
FIG. 1 is a perspective view of the desktop elevator in its lowered orientation.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

As referenced previously, the desktop elevator of the present invention is capable of attaching to the top of an existing desk or workstation establishing a platform that can be quickly and easily elevated to enable a user to stand or lowered to enable a user to sit. These alternative positions can be readily appreciated in viewing the appended figures and particularly FIGS. 1 and 2.

Figure 2:
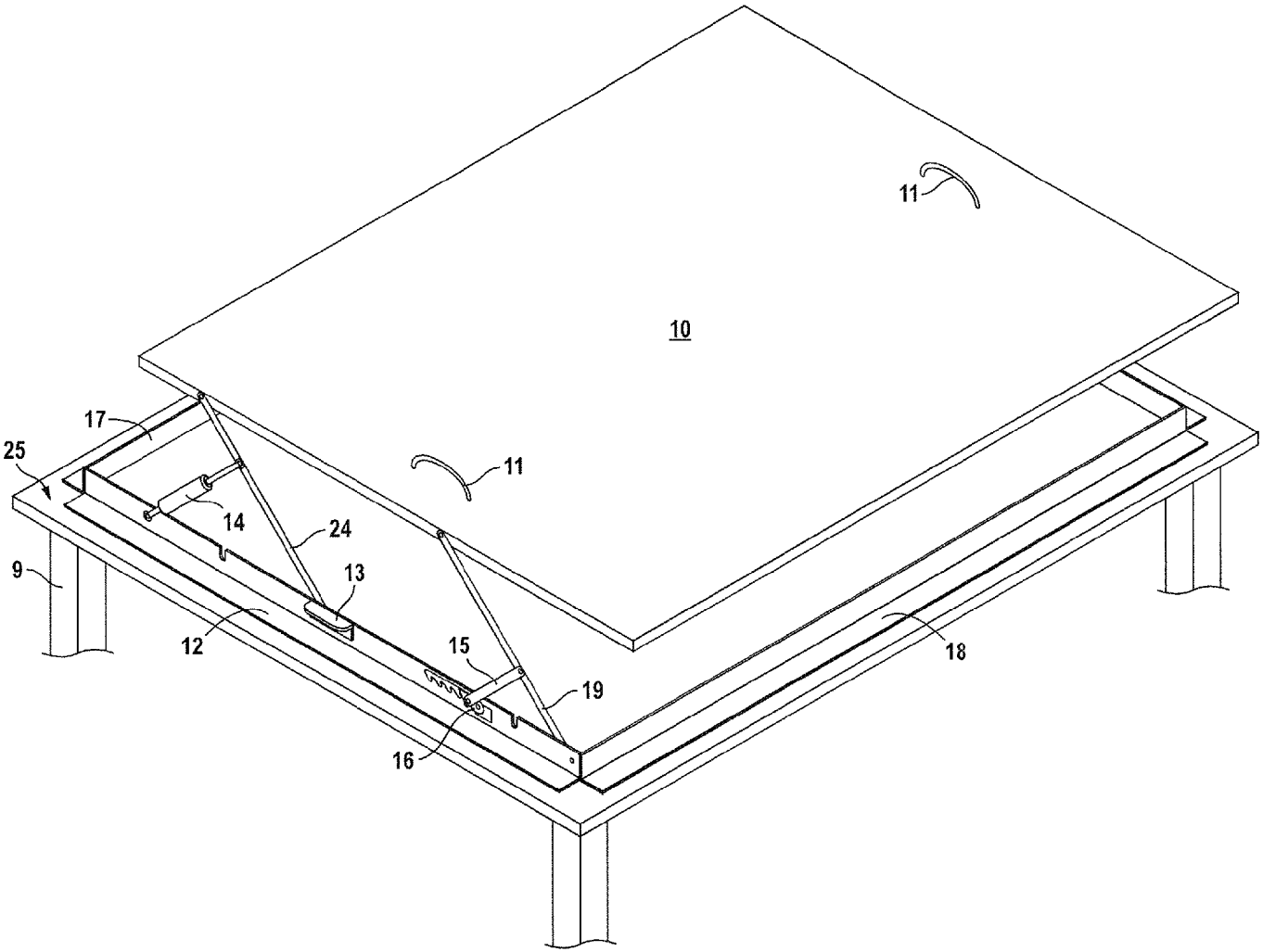
FIG. 2 is a perspective view of the desktop elevator of the present invention in its raised orientation.

In turning to FIG. 1, preexisting desk 5 having legs 9 is typical of an article of furniture one might use to support a computer acting as a workstation. In that legs 9 are generally not adjustable, the height of desk 5 is fixed resulting in an inflexible user orientation which can cause those health risks previously noted. In converting desk 5 into one which has an adjustable height, a frame is configured of parallel side frame members 12 and 8 (FIG. 5), back frame member 17 and front frame member 18, said frame members being orthogonally attached end to end to create a square or rectangular perimeter as illustrated. Finger grips 13 can be provided to enable one to remove or apply the present desktop elevator to desk 5 while handles 11 can be employed to elevate platform 10 from its position of FIG. 1 to its elevated position of FIG. 2.

Figure 3:
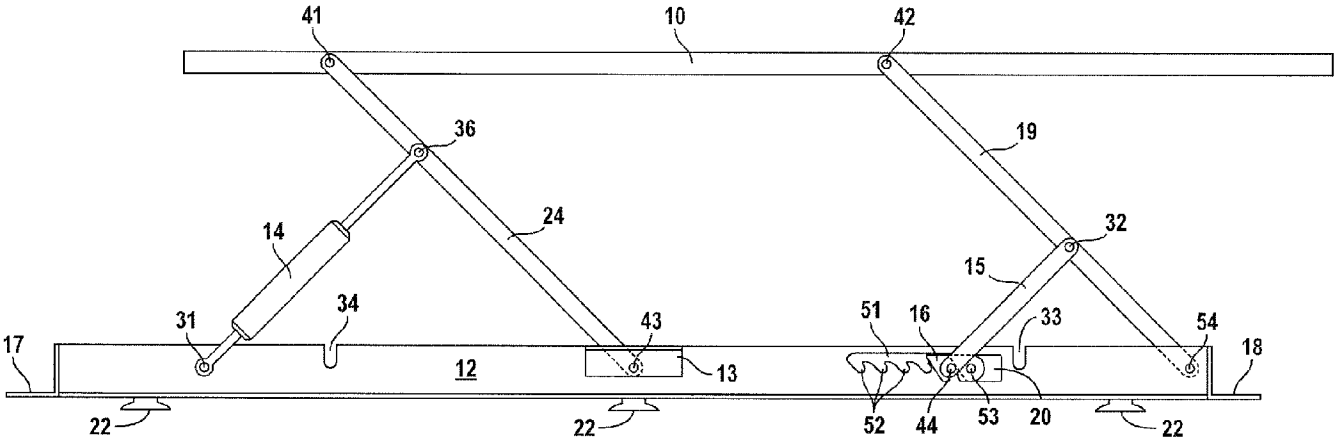
FIG. 3 is a side view of a portion of the desktop elevator of the present invention illustrating its rotating front and back braces for use herein.
Figure 4:
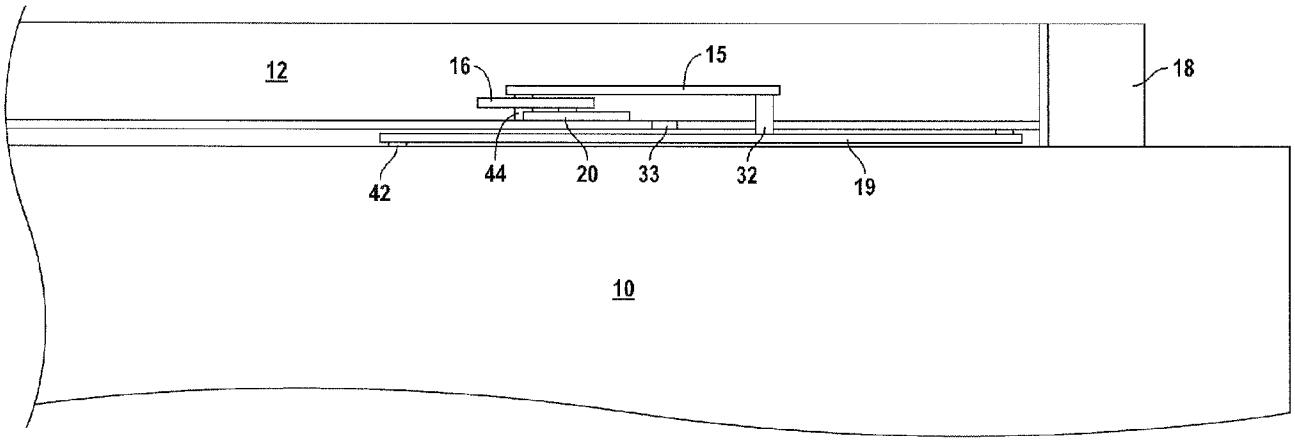
FIG. 4 is a side view of a frame member of the present invention showing the details of the latch mechanism for use herein.

In order to gain further insight as to the functionality of the present invention, reference is made to FIG. 3. Specifically, back rotating brace 24 and front rotating brace 19 are substantially parallel to one another and are rotatably attachable to platform 10 at pivots 41 and 42 and side frame 12 at pivot points 43 and 54 respectively.

Back rotating brace 24 is further secured by spring 14 which, in its preferred embodiment, is an air spring pivotally connected to side frame 12 at 31 and to back rotating brace 24 at 36. Front rotating brace 19 is secured by locking arm 15 connected to side frame 12 at pin 44 and to front rotating brace 19 at 32. When platform 10 is lowered to base 25 as depicted in FIG. 1, pivot 36 can nest within cutout 34 while pivot 32 nests within cutout 33 of side frame 12 to ensure the appropriate seating of platform 10 proximate support 25.

Figure 6:
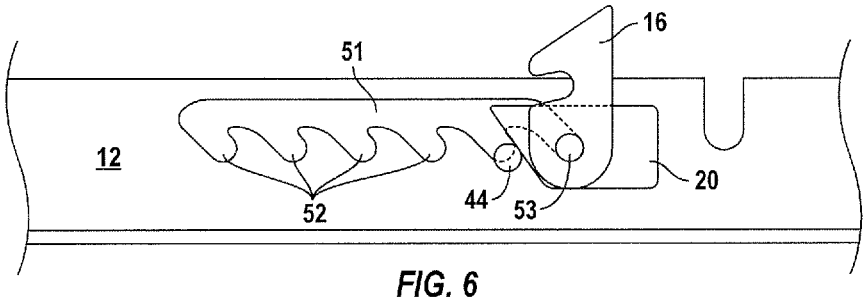
FIGS. 6 and 7 are partial cutaway views of a frame member illustrating the present locking latch in open and closed alternative orientations.
Figure 7:
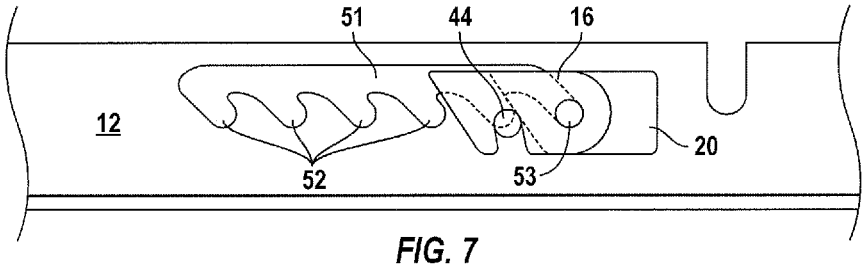

In order to maintain platform 10 in its selected altitude, it is noted that the present invention is provided with locking latch 16 as part of assembly 20. In operation, locking latch 16 is capable of rotating about pivot 53 in a counterclockwise fashion to enable locking latch 16 to capture pin 44 projecting from locking arm 15. If platform 10 is intended to be raised or lowered, locking latch 16 would move along channel 51 wherein pivot 53 (FIG. 6) would move between cutouts 52. Pin 44 would abut locking latch 16. Locking latch 16 would then rotate counterclockwise about pivot 53 to fix the altitude of platform 10 as selected (FIG. 7). It is further noted that platform 10 can be lowered by simply placing downward pressure upon its surface when latch 16 is disengaged from pin 44 (FIG. 6) and can be raised by grasping handles 11 and pulling upwardly, again, when latch 16 has been disengaged.

Figure 5:
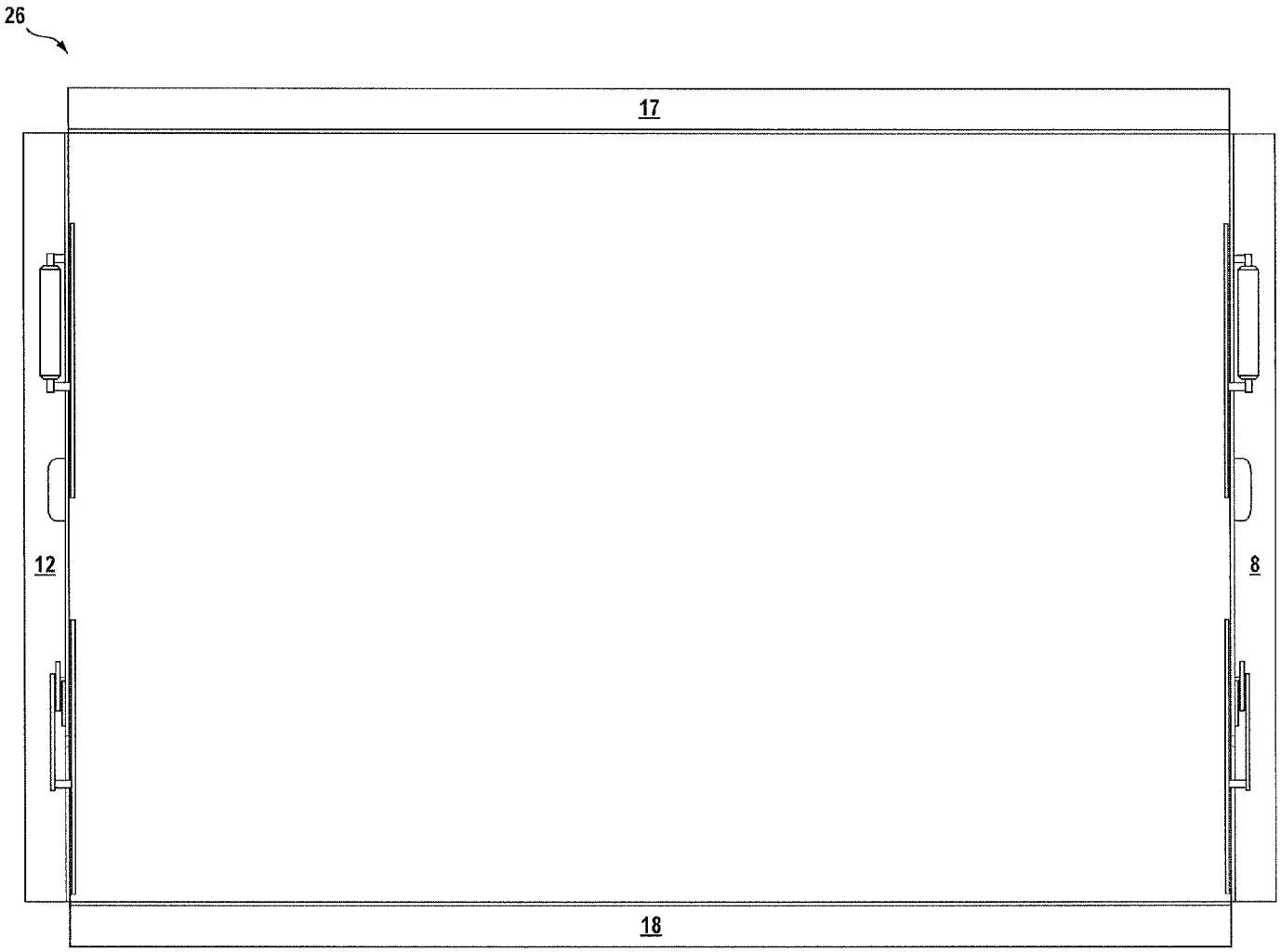
FIG. 5 is a top plan view of the present invention illustrating its positioning on a suitable base member.

As noted in reference to FIG. 5, a series of back and front rotating braces, springs and locking arms can be applied to opposing frame members 8 and 12 for stability and to ensure that as platform 10 moves away from or towards support 25, that platform 10 remains substantially parallel thereto and generally in a horizontal orientation. The desktop elevator can also be provided with finger grips 13 to enable one to grasp the elevator and remove it from support 25 enabling support 25 to remain as a conventional desk or work surface and to enable the present desktop elevator to be positioned on yet another surface as desired. In doing so, suction cups 22 or similar securing means must be disengaged from support 25 and applied to a new surface as desired.

From the above discussion, it should be quite apparent that the present invention provides a significant improvement in the ergonomics of one's working environment and enable a user to alternate between sitting and standing to thus reduce health risks, and general fatigue while increasing productivity.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A desktop elevator for providing a platform at an elevation adjustable by a user, said desktop elevator being supported on a surface sized to receive it, said desktop elevator comprising left, right, front and back frame members defining a support, said frame members being orthogonally attached end to end to one another, a platform vertically adjustable to a user selected altitude to and from said support, front and back rotatable brace members positioned on two opposing frame members, each having a first end rotatable to said platform and a second end rotatable to a frame member, springs each rotatably bridging an opposing frame member to a back rotatable brace member along its length and locking arms each bridging an opposing frame member to a front rotatable brace member, locking pins positioned proximate the ends of each of said locking arms at each of said opposing frame members and locking latches each having a pivot and releasably engageable to said locking pins, said platform being distanced from said support upon lifting said platform therefrom when said locking latches are disengaged from said locking pins and said platform being drawn to and remaining adjacent to said support when pressure is applied to said platform toward said support and said locking latches are disengaged from said locking pins, wherein said two opposing frame members are each configured with a channel, and said locking latch is configured to move along said channel.

2. The desktop elevator of claim 1 wherein each said channel comprises a plurality of cutouts, each cutout being configured to selectively receive said pivot, the cutout selected for receiving said pivot determining the distance of said platform from said support when said platform is raised therefrom or lowered thereto.

3. The desktop elevator of claim 2 wherein each locking latch rotates about said pivot applied to each of said two opposing frame members, to selectively engage said locking pins.

4. The desktop elevator of claim 1 wherein said spring is an air spring.

5. The desktop elevator of claim 1 wherein said platform further comprises handles for gripping to facilitate lifting of said platform from said support.

6. The desktop elevator of claim 1 wherein said platform and said support surface remain substantially parallel to one another independent of the distance between said platform and said support surface.

* * * * *